US010197032B2

(12) United States Patent
Kromer

(10) Patent No.: US 10,197,032 B2
(45) Date of Patent: Feb. 5, 2019

(54) FUEL INJECTION SYSTEM AND HYDRAULIC CONNECTION TO A FUEL INJECTION SYSTEM

(71) Applicant: Robert Bosch GmbH, Stuttgart (DE)

(72) Inventor: Ralf Kromer, Vaihingen (DE)

(73) Assignee: ROBERT BOSCH GMBH, Stuttgart (DE)

( * ) Notice: Subject to any disclaimer, the term of this patent is extended or adjusted under 35 U.S.C. 154(b) by 0 days.

(21) Appl. No.: 15/561,425

(22) PCT Filed: Feb. 10, 2016

(86) PCT No.: PCT/EP2016/052760

§ 371 (c)(1),
(2) Date: Sep. 25, 2017

(87) PCT Pub. No.: WO2016/155928

PCT Pub. Date: Oct. 6, 2016

(65) Prior Publication Data

US 2018/0058403 A1 Mar. 1, 2018

(30) Foreign Application Priority Data

Apr. 2, 2015 (DE) ..... 10 2015 205 980

(51) Int. Cl.
*F02M 55/02* (2006.01)

(52) U.S. Cl.
CPC ..... *F02M 55/025* (2013.01); *F02M 2200/856* (2013.01)

(58) Field of Classification Search
CPC ..... F02M 55/025; F02M 2200/856; F02M 69/465

(Continued)

(56) References Cited

U.S. PATENT DOCUMENTS 7,004,145 B2 * 2/2006 Zander ..... F02M 55/005 123/456
7,461,636 B2 * 12/2008 Ricco ..... F02M 55/005 123/456

(Continued)

FOREIGN PATENT DOCUMENTS

DE 102005045731 A1 4/2007
EP 1752655 A1 2/2007

(Continued)

OTHER PUBLICATIONS

International Search Report, dated Apr. 14, 2016 of the corresponding International Application PCT/EP2016/052760 filed Feb. 10, 2016.

*Primary Examiner* — Hai Huynh
(74) *Attorney, Agent, or Firm* — Norton Rose Fulbright US LLP; Gerard Messina

(57) ABSTRACT

A hydraulic connection via which a fuel injector is connectable to a fuel-conducting component and which includes a retaining bridge having a support surface. A connecting piece of a fuel injector is supportable on the support surface of the retaining bridge. A hydraulic connection being formed between the connecting piece of the fuel injector and a connection. A convexly curved bearing surface is provided on the connection, and a support surface is formed on the connecting piece of the fuel injector. A contact between the connecting piece of the fuel injector and the connection is implemented on the convexly curved bearing surface and the support surface for forming the hydraulic connection. The support surface is designed axially symmetrically with respect to a longitudinal axis. The support surface is designed in a widened manner in a direction from the connecting piece toward the connection along the longitudinal axis.

15 Claims, 2 Drawing Sheets

(58) Field of Classification Search
USPC ..... 123/456, 468, 469, 470
See application file for complete search history.

(56) References Cited

U.S. PATENT DOCUMENTS

| | | | | |
|---|---|---|---|---|
| 7,735,473 | B2 * | 6/2010 | Kato | F02M 55/005 123/468 |
| 9,157,401 | B2 * | 10/2015 | Stieler | F02M 55/004 |
| 2005/0045152 | A1 | 3/2005 | Zander | |

FOREIGN PATENT DOCUMENTS

| | | | |
|---|---|---|---|
| JP | 2008542601 | A | 11/2008 |
| JP | 2009533591 | A | 9/2009 |

* cited by examiner

FUEL INJECTION SYSTEM AND HYDRAULIC CONNECTION TO A FUEL INJECTION SYSTEM

FIELD

The present invention relates to a fuel injection system including a fuel-conducting component and multiple fuel injectors and to a hydraulic connection to such a fuel injection system. The fuel injectors may be connected via a respective hydraulic connection to the fuel-conducting component, in particular a fuel rail. The present invention specifically relates to the field of mixture-compressing, spark ignition internal combustion engines.

BACKGROUND INFORMATION

A fuel injection system including a fuel rail and a fuel injector is described in European Patent No. EP 2 375 052 A1. A coupling device is provided, which includes a cup designed in such a way that it is hydraulically coupled to the fuel rail and forms a connection to a fuel inlet portion of the fuel injector. The cup has two boreholes through which screws extend. The ends of the screws are screwed into a plate, which engages at the fuel injector via a ring. The fuel injector is moreover held via a further ring so that a movement of the fuel injector in the two directions along a longitudinal axis is blocked. This known embodiment has the disadvantage that no pretensioning force is transmitted to the fuel injector.

Furthermore, an embodiment in which the fuel injector is sealed via a metallic ball/cone seal with respect to the fuel injector is conceivable. When the fuel injector is pulled against the rail via two screws with such a seal, this results in the problem that flexural stresses, which arise when the screws are unevenly tightened, are introduced into the fuel injector. To avoid this problem, pivoting motions between the fuel inlet portion of the fuel injector and the cup are possible via the ball/cone seal. This, however, then results in the problem that the size increases considerably, in particular along the longitudinal axis. With respect to the space constraints generally found, in particular inside an engine compartment of a motor vehicle or the like, this considerably limits the use of such possible approaches.

SUMMARY

An example hydraulic connection according to the present and an example fuel injection system according to the present invention may have the advantage that an improved design and an improved functionality of the hydraulic connection are made possible. Specifically, a hydraulic connection of the fuel injector to the fuel-conducting component may be made possible, in which stresses, in particular flexural stresses, are avoided and a small installation space is made possible.

The measures described herein may allow advantageous refinements of the hydraulic connection, and the fuel injection system.

It is advantageous if the convexly curved bearing surface of the connection is designed as a bearing surface curved in the shape of a spherical surface. Furthermore it is advantageous if the convexly curved bearing surface of the connection is formed on a portion of the connection on the fuel-conducting component which is designed in the shape of a partial sphere. The connection of the fuel-conducting component may in particular be designed as a rail connection when the fuel-conducting component is a fuel distributor. An outlet channel of the fuel-conducting component preferably extends along the longitudinal axis. Specifically, such an outlet channel may open from the connection into the connecting piece of the fuel injector in the center of the bearing surface of the connection which is curved in the shape of a spherical surface.

It is also advantageous if the connecting piece rests with a spherical surface-shaped geometry against the support surface of the retaining bridge. It is furthermore advantageous when a center point of the bearing surface curved in the shape of a spherical surface, or of the partial sphere-shaped portion of the connection, and a center point of the spherical surface-shaped geometry on the support surface coincide at least approximately. In this way, an advantageous suspension may be implemented, in which a low-stress attachment of the fuel injector, or of the connecting piece of the fuel injector, to the fuel-conducting component is possible, because the coinciding center points result in an advantageous pivotability of the connecting piece during assembly.

It is also advantageous that the center point of the bearing surface curved in the shape of a spherical surface, or of the partial sphere-shaped portion of the connection, and the center point of the spherical surface-shaped geometry on the support surface are at least approximately situated on the longitudinal axis in a normal position, in which the connection, the connecting piece and the support surface of the retaining bridge are aligned on the longitudinal axis. During assembly, the retaining bridge may then be attached to the fuel-conducting component via two screws, for example, and be pulled against the fuel-conducting component. Via the advantageous suspension, a compensation, which results in a low-stress attachment, is already made possible during assembly.

Furthermore, it is advantageous that the support surface of the connecting piece is designed as a support surface of the connecting piece configured as a lateral surface of a truncated cone. This enables an advantageous cooperation specifically with a bearing surface curved in the shape of a spherical surface, or a bearing surface which is formed on a partial sphere-shaped portion of the connection. The contact between the connecting piece of the fuel injector and the connection may advantageously be an outer edge area of the support surface of the connecting piece configured as a lateral surface of a truncated cone. This results in an installation space-optimized design, in which in particular the length along the longitudinal axis may be kept short.

Furthermore, it is advantageous if the retaining bridge, with respect to its support surface, is able to be acted upon on both sides against the fuel distributor to allow the connecting piece to be acted upon along the longitudinal axis against the bearing surface of the rail connection. In this way, the assembly may be at least approximately ensured in the normal position in which the connection, the connecting piece and the support surface of the retaining bridge are aligned on the longitudinal axis. The extent of tilting motions which may occur during assembly, which allow stress-free assembly and attachment, may thus be reduced.

The convexly curved bearing surface is preferably curved in the shape of a spherical surface; however, it may also be configured corresponding to a functionally equivalent surface area. The support surface of the connecting piece is preferably configured as a lateral surface of a truncated cone; however, it may also be configured corresponding to a functionally equivalent surface area. It is advantageous in this regard that a pivot point about which the connecting piece resting against the support surface of the retaining bridge is pivotable relative to the retaining bridge and a pivot point about which the connecting piece resting against the convexly curved bearing surface is pivotable relative to the connection coincide at least approximately. Depending on design, the pivot points may coincide with the relevant center points of spherical surfaces.

Moreover, it is advantageous if a pivot point about which the connecting piece resting against the support surface of the retaining bridge is pivotable relative to the retaining bridge and a pivot point about which the connecting piece resting against the convexly curved bearing surface is pivotable relative to the connection are situated at least approximately on the longitudinal axis in a normal position, in which the connection, the connecting piece and the support surface of the retaining bridge are aligned on the longitudinal axis. In this way, the stress-free assembly may be achieved in a particularly advantageous manner.

BRIEF DESCRIPTION OF THE DRAWINGS

Preferred exemplary embodiments of the present invention are described in greater detail below with reference to the figures, in which corresponding elements are provided with concurrent reference numerals.

DETAILED DESCRIPTION OF EXAMPLE EMBODIMENTS

Figure 1:
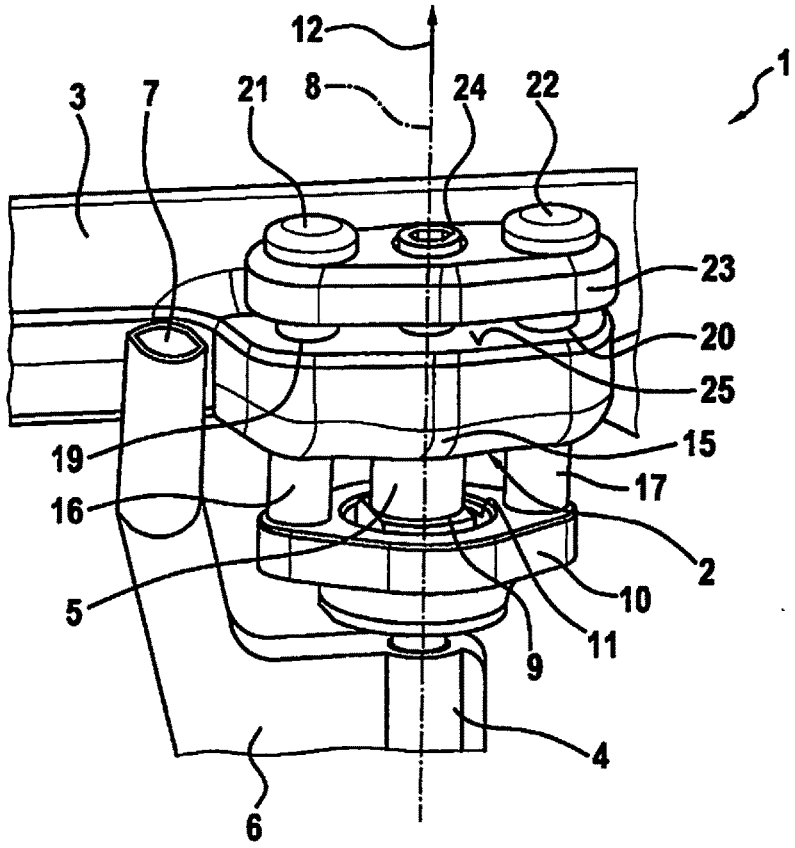
FIG. 1 shows a fuel injection system including a hydraulic connection in an excerpted, schematic, spatial illustration corresponding to an exemplary embodiment of the present invention.

FIG. 1 shows a fuel injection system 1 including a hydraulic connection 2 in an excerpted, schematic, spatial illustration corresponding to an exemplary embodiment. Fuel injection system 1 includes a fuel-conducting component 3 and a fuel injector 4. Fuel injector 4 is connected via hydraulic connection 2 to fuel-conducting component 3. Preferably, further fuel injectors corresponding to fuel injector 4 are provided, which are connected via further hydraulic connections designed corresponding to hydraulic connection 2 to fuel-conducting component 3. Fuel-conducting component 3 may in particular be designed as a fuel distributor 3. Such a fuel distributor 3 may in particular be a fuel distributor block 3, in particular a fuel rail 3. Hydraulic connection 2 is particularly suitable for such fuel-conducting components 3. Preferred applications are mixture-compressing, spark ignition internal combustion engines for which such a fuel injection system 1 or such hydraulic connections 2 are used. Fuel injection system 1 according to the present invention and hydraulic connection 2 according to the present invention, however, are also suitable for other applications in this or a possibly suitably modified form.

Fuel injector 4 includes a connecting piece 5. Fuel injector 4 furthermore includes an overmold 6 on which an electrical connection 7 is formed. Connecting piece 5 is aligned along a longitudinal axis 8 in a normal position in which the assembly preferably takes place.

A collar 9 is formed on connecting piece 5. A retaining bridge 10, on which a support surface 11 is configured, is provided for attaching connecting piece 5 of fuel injector 4 to fuel-conducting component 3. Connecting piece 5 is braced on support surface 11 of retaining bridge 10, retaining bridge 10 being acted on in a direction 12. This action results in a seal on hydraulic connection 2.

A connection 15, which in this exemplary embodiment is designed as a rail connection 15, is provided on fuel-conducting component 3. Connecting piece 5 of fuel injector 4 is connected to connection 15. For this purpose, retaining bridge 10, with respect to its support surface 11, is able to be acted upon on both sides via attachment elements 16, 17 against connection 15 of fuel-conducting component 3 (fuel distributor 3) in order to allow connecting piece 5 to be acted upon along longitudinal axis 8 against a bearing surface 18 (FIG. 2) of connection 15. In this exemplary embodiment, attachment elements 16, 17 are designed as guide elements 16, 17, which are guided through cylindrical guide recesses 19, 20 on connection 15. Attachment elements 16, 17 have cap-shaped ends 21, 22 to allow bracing on a support part 23. Support part 23 is acted on by a tightening force via a screw 24, which is braced on an upper side 25 of connection 15. Due to this tightening force, attachment elements 16, 17 designed as guide elements 16, 17 transmit the tightening force of screw 24 via retaining bridge 10 onto connecting piece 5.

In a modified embodiment, attachment elements 16, 17 may also be designed as screw elements, which apply the tightening force by being screwed into retaining bridge 10 on both sides of support surface 11.

Figure 2:
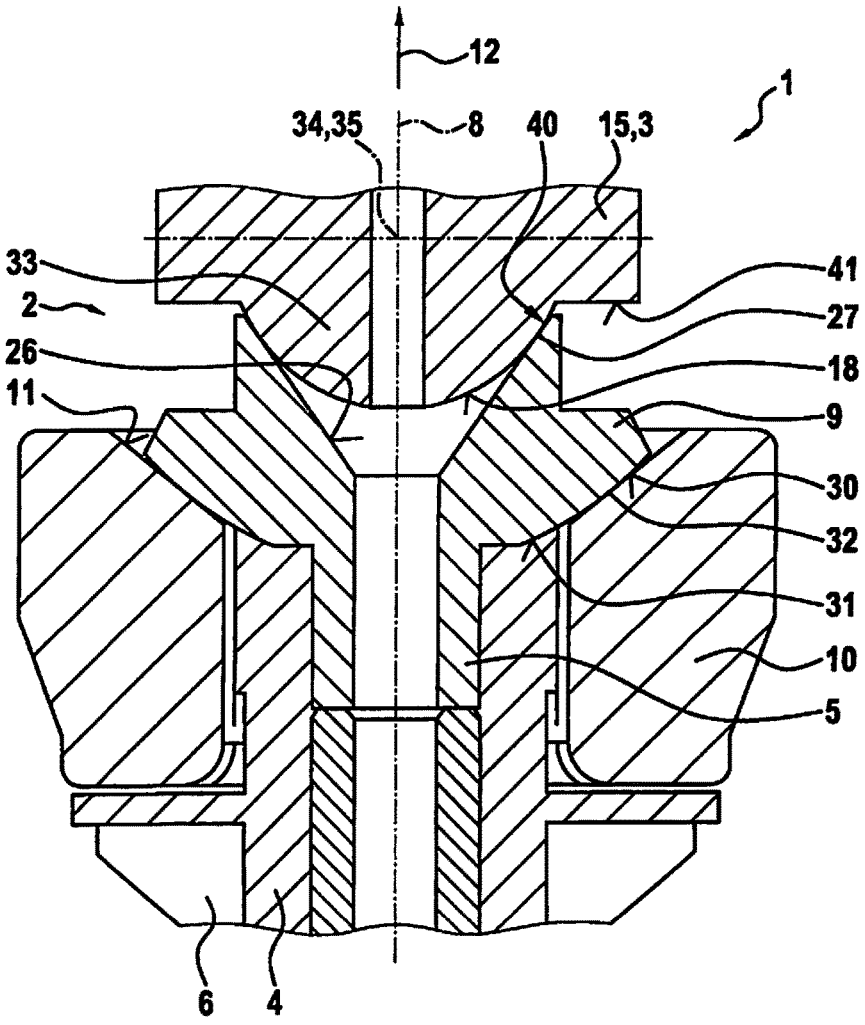
FIG. 2 shows an excerpted, schematic sectional view through the fuel injection system shown in FIG. 1 corresponding to the exemplary embodiment of the present invention.

FIG. 2 shows an excerpted, schematic sectional view through fuel injection system 1 shown in FIG. 1 corresponding to the exemplary embodiment. Connection 15 is illustrated in a simplified manner, specifically bearing surface 18 functionally relevant for hydraulic connection 2 being shown. Bearing surface 18 of connection 15 is designed as a convexly curved bearing surface 18. A support surface 26 is formed on connecting piece 5 of fuel injector 4. Support surface 26 of connecting piece 5 is designed axially symmetrically with respect to longitudinal axis 8. Furthermore, support surface 26 widens in direction 12 along longitudinal axis 8, which points from connecting piece 5 to connection 15. In this exemplary embodiment, support surface 26 is configured as a lateral surface 26 of a truncated cone. A contact exists between bearing surface 18 of connecting piece 15 and support surface 26 of connecting piece 5, whereby a hydraulic connection exists. The sealing of this hydraulic connection takes place at a contact point 27 or a circular line-shaped contact line 27. With respect to the geometry of support surface 26, longitudinal axis 8 is regarded as the longitudinal axis of connecting piece 5. FIG. 2 moreover shows a normal position in which connection 15, connecting piece 5 and support surface 11 of retaining bridge 10 are aligned on longitudinal axis 8.

In this exemplary embodiment, the hydraulic connection is established at contact point 27 or contact line 27 between connecting piece 5 of fuel injector 4 and connection 15 of fuel-conducting component 3. This results in an advantageous cooperation of support surface 26 of connecting piece 5 with convexly curved bearing surface 18 of connection 15 in combination with an advantageous support of connecting piece 5 on support surface 11 of retaining bridge 10.

Connecting piece 5 has a spherical surface-shaped geometry 30 on its outer side 31 in the area on which a contact occurs with support surface 11 of retaining bridge 10 within the scope of possible pivoting motions. The contact may, for example, take place at a contact point 32 or a contact line 32, which may also be a broken line. Support surface 11 of retaining bridge 10 has a geometry adapted thereto, which in this exemplary embodiment is implemented by a lateral surface 11 of a truncated cone.

In this exemplary embodiment, bearing surface 18 of connection 15 extends across a partial sphere-shaped, in particular almost half sphere-shaped portion 33 of connection 15. Such a sphere geometry, however, may also only be implemented in a portion relevant for the function in order to form bearing surface 18 as a partial surface area of a spherical surface.

A center point 34 of bearing surface 18 curved in the shape of a spherical surface, or of partial sphere-shaped portion 33 of connection 15, and a center point 35 of spherical surface-shaped geometry of outer side 31 of connecting piece 5 on support surface 11 coincide at least approximately. Furthermore, in this exemplary embodiment these center points 34, 35 are situated on longitudinal axis 8 in the illustrated normal position, in which connection 15, connecting piece 5 and support surface 11 of retaining bridge 10 are aligned on longitudinal axis 8. Fuel injector 4 or connecting piece 5 may thus be pivoted with respect to connection 15 of fuel-conducting component 3 during assembly without experiencing any stress. Center points 34, 35 thus preferably coincide at least approximately. In a modified embodiment, however, minor positional deviations of center points 34, 35 may also be provided if this ensures a sufficiently low-stress assembly.

Further possible modifications relate to the sphere/cone geometries of connecting piece 5 of support surface 11 and of connection 15. Support surface 11 of retaining bridge 10 may have not only a cone-shaped lateral surface, but also a different support surface 11 widening in direction 12, via which retaining bridge 10 acts on a spherical surface-shaped geometry 30 or also another convex and/or sphere-like geometry 30 of connecting piece 5 in order to press connecting piece 5 against bearing surface 18 of connection 15. To allow connecting piece 5 to be pivoted relative to fuel-conducting component 3 during assembly without experiencing any stress, not only center points 34, 35, but also pivot points 34, 35 of comparable surface areas or geometries may coincide. In this way, a pivot point 35 about which connecting piece 5 resting against support surface 11 of retaining bridge 10 is pivotable relative to retaining bridge 10 may coincide at least approximately with a pivot point 34 about which connecting piece 5 resting against convexly curved bearing surface 18 is pivotable relative to connection 15. These pivot points 34, 35 may, in turn, be situated on longitudinal axis 8 in the normal position.

Contact point 27 or contact line 27 is preferably situated in an outer edge region of support surface 26 of connecting piece 5. In this way, a distance between collar 9 of connecting piece 5 and a lower side 41 of connection 15 facing collar 9 may be optimally selected to be small. Partial sphere-shaped portion 33 is situated only so far outside connecting piece 5 that the functionally required tilting is still made possible, without connecting piece 5 striking against lower side 41 of connection 15.

An axial installation space along longitudinal axis 8 may thus be considerably reduced.

The present invention is not limited to the described exemplary embodiments or modifications.

What is claimed is:

1. A device via which a fuel injector is hydraulically connectable to a fuel distributor, the device comprising:

a retaining bridge which has a support surface;

a connecting piece of a fuel injector supportable on the support surface of the retaining bridge; and a connection;

wherein:

a convexly curved bearing surface is formed on the connection;

a support surface is formed on the connecting piece of the fuel injector, on which, for hydraulically connecting the connecting piece of the fuel injector and the connection, a contact between the connecting piece of the fuel injector and the connection exists;

the support surface of the connecting piece is axially symmetrical with respect to a longitudinal axis; and the support surface of the connecting piece is, in cross-sectional view, a straight sloping surface that is conically shaped, widening in a direction from the connecting piece toward the connection along the longitudinal axis.

2. The device as recited in claim 1, wherein at least one of: (i) the convexly curved bearing surface of the connection is designed as a bearing surface curved in a shape of a spherical surface, and (ii) the convexly curved bearing surface of the connection is formed on a partial sphere-shaped portion of the connection.

3. The device as recited in claim 2, wherein the connecting piece rests with a spherical surface-shaped geometry against the support surface of the retaining bridge.

4. The device as recited in claim 3, wherein a center point of the bearing surface curved in the shape of a spherical surface, or of the partial sphere-shaped portion of the connection, and a center point of the spherical surface-shaped geometry of the connecting piece on the support surface of the retaining bridge coincide at least approximately.

5. The device as recited in claim 2, wherein a center point of the bearing surface curved in the shape of a spherical surface, or of the partial sphere-shaped portion of the connection, and a center point of the spherical surface-shaped geometry on the support surface are at least approximately situated on the longitudinal axis in a normal position, in which the connection, the connecting piece and the support surface of the retaining bridge are aligned on the longitudinal axis.

6. The device as recited in claim 1, wherein the support surface of the connecting piece is designed as a a truncated cone.

7. The device as recited in claim 6, wherein contact between the connecting piece of the fuel injector and the connection exists in an outer edge area of the support surface of the connecting piece configured as a lateral surface of a truncated cone.

8. The device as recited in claim 1, wherein the retaining bridge, with respect to its support surface, is able to be acted upon on both sides against the connection in order to allow the connecting piece to be acted upon along the longitudinal axis against the bearing surface of the connection.

9. The device as recited in claim 1, wherein a pivot point about which the connecting piece resting against the support surface of the retaining bridge is pivotable relative to the retaining bridge and a pivot point about which the connecting piece resting against the convexly curved bearing surface is pivotable relative to the connection coincide at least approximately.

10. The device as recited in claim 1, wherein a pivot point about which the connecting piece resting against the support surface of the retaining bridge is pivotable relative to the retaining bridge and a pivot point about which the connecting piece resting against the convexly curved bearing surface is pivotable relative to the connection are at least approximately situated on the longitudinal axis in a normal position, in which the connection, the connecting piece and the support surface of the retaining bridge are aligned on the longitudinal axis.

11. The device as recited in claim 1, wherein the longitudinal axis is a shared central longitudinal axis of the fuel injector and an entirety of the connecting piece.

12. A fuel injection system for a mixture-compressing, spark ignition internal combustion engine, the fuel injection system comprising:

a retaining bridge that includes a support surface;

a fuel injector that includes a connecting piece;

a fuel-conducting component that includes a connection that is hydraulically connected to the connecting piece of the fuel injector wherein:

the connecting piece of the fuel injector is supportable on the support surface of the retaining bridge;

a convexly curved bearing surface is formed on the connection;

a support surface is formed on the connecting piece of the fuel injector, on which, for forming the hydraulic connection, a contact between the connecting piece of the fuel injector and the connection exists;

the support surface of the connecting piece is axially symmetrical with respect to a longitudinal axis; and the support surface of the connecting piece is, in cross-sectional view, a straight sloping surface that is conically shaped, widening in a direction from the connecting piece toward the connection along the longitudinal axis.

13. A device via which a fuel injector is hydraulically connectable to a fuel distributor, the device comprising:

a retaining bridge that includes a support surface;

a connecting piece of a fuel injector supportable on the support surface of the retaining bridge; and a connection;

wherein:

a convexly curved bearing surface is formed on the connection;

a support surface is formed on the connecting piece of the fuel injector, on which, for hydraulically connecting the connecting piece of the fuel injector and the connection, a contact between the connecting piece of the fuel injector and the connection exists;

the support surface of the connecting piece is axially symmetrical with respect to a longitudinal axis;

the support surface of the connecting piece widens in a direction from the connecting piece toward the connection along the longitudinal axis;

the support surface is located at a middle region of the retaining bridge at the longitudinal axis; and the retaining bridge includes, at each of at least one edge region thereof, distal from the longitudinal axis, a respective attachment element that extends from a top surface of the retaining bridge into and through the connection.

14. The device as recited in claim 13, wherein the at least one edge region includes at least two edge regions distal from the longitudinal axis, at each of which the retaining bridge include the respective attachment element.

15. The device as recited in claim 13, further comprising, for each of the at least one attachment element, a respective cap that is attached to a top of the respective attachment element above the connection.

* * * * *